US008397909B2

(12) United States Patent
Webb

(10) Patent No.: US 8,397,909 B2
(45) Date of Patent: Mar. 19, 2013

(54) CHISEL CASE

(76) Inventor: John Webb, Chatham (GB)

( * ) Notice: Subject to any disclaimer, the term of this patent is extended or adjusted under 35 U.S.C. 154(b) by 0 days.

(21) Appl. No.: 13/386,691

(22) PCT Filed: Jul. 23, 2010

(86) PCT No.: PCT/GB2010/051218

§ 371 (c)(1),
(2), (4) Date: Jan. 24, 2012

(87) PCT Pub. No.: WO2011/010162

PCT Pub. Date: Jan. 27, 2011

(65) Prior Publication Data

US 2012/0118775 A1 May 17, 2012

(30) Foreign Application Priority Data

Jul. 24, 2009 (GB) ..... 0912930.5

(51) Int. Cl.
*B65D 81/02* (2006.01)
*A45C 11/26* (2006.01)

(52) U.S. Cl. ..... 206/349; 206/523

(58) Field of Classification Search ..... 206/349, 206/361, 379, 443, 446, 521, 523, 591, 593, 206/594; 211/70.6
See application file for complete search history.

(56) References Cited

U.S. PATENT DOCUMENTS

| | | | | |
|---|---|---|---|---|
| 3,512,631 | A * | 5/1970 | Braun et al. | 206/349 |
| 5,031,765 | A * | 7/1991 | Chen | 206/349 |
| 5,515,971 | A * | 5/1996 | Segrest | 206/591 |
| 5,979,649 | A * | 11/1999 | Rosler | 206/379 |
| 7,175,023 | B2 * | 2/2007 | Martin | 206/349 |
| 7,537,116 | B2 * | 5/2009 | Roesler | 206/379 |
| 2002/0148746 | A1 | 10/2002 | Eriksson | |
| 2005/0098458 | A1 * | 5/2005 | Gruetzmacher et al. | 206/349 |
| 2006/0231444 | A1 | 10/2006 | Roesler | |
| 2006/0283769 | A1 * | 12/2006 | Roesler | 206/379 |

OTHER PUBLICATIONS

International Search Report for PCT Patent Application No. PCT/GB2010/051218.

* cited by examiner

*Primary Examiner* — Luan K Bui

(57) ABSTRACT

A chisel case (50) includes a hollow unitary body portion (52) and a removable cap portion (54). The body portion (52) has a substantially cylindrical section (56) for receiving a chisel handle (70). A substantially elongate box section (58) adjoins and is integrally formed with the body portion (52) and in use receives a chisel blade (66). A chisel (62) is contained within the chisel case (50) and is supported by a deformable blade supporting means (64) disposed at the end of the elongate box section (58) and a deformable handle supporting means (68) disposed within the cap portion (54).

12 Claims, 4 Drawing Sheets

CHISEL CASE

The present invention relates to a chisel case and particularly, but not exclusively, to a chisel case for storing and protecting a woodworking chisel.

BACKGROUND TO THE INVENTION

At present, chisel cases are generally designed to hold a number of chisels, however these cases typically do not ensure that a chisel blade is comprehensively protected from damage through contact with other tools or chisels. When in transit, chisel blades can become chipped or otherwise damaged, resulting in the chisel having to be re-sharpened prior to use.

It is an object of the invention to provide a chisel case which provides a secure housing for a chisel and reduces the possibility of damage to the chisel or the blade of the chisel in storage or transport.

SUMMARY OF THE INVENTION

According to the present invention there is provided a chisel case for housing a single chisel comprising first and second unitary hollow body portions, a deformable blade supporting means disposed within the first body portion and a deformable handle supporting means disposed within the second body portion, the first body portion being formed at one end as a substantially elongate rectangular box section for receiving a blade portion of a chisel.

The hollow unitary first and second body portions provide a fully enclosed vessel in which a chisel can be contained therein, preventing the chisel from making potentially damaging contact with other tools. The deformable supporting means ensures the immobilisation of the chisel within the chisel case.

At least one tapered transitional portion may be provided adjoining the box section, which extends to a substantially circular end and the tapered transitional portion may include two substantially planar opposing surfaces, the width of said planar surfaces increasing as the taper decreases. This reduces movement of the chisel within the case, ensures the necessary size of the case is minimised and the appearance of the case can be streamlined. The taper decreases as it approaches the elongate rectangular box section.

The first body portion may be open-ended at the circular end for receiving the chisel.

The circular end may be provided substantially as a ring with a continuous outwardly directed flange extending therefrom, said flange being inset from a free edge of the ring.

The second body portion may be formed as a tube having a substantially circular lateral cross-section.

The second body portion may be open-ended at one end for receiving a handle of the chisel.

In order to ensure the second body portion remains attached to the first body portion in use, a circumferential neck may be disposed at the open end of the second body portion, said neck having a plurality of spaces provided therethrough, and the ring of the first body portion having a plurality of outwardly directed flange portions extending therefrom for engaging the spaces of the circumferential neck in a bayonet engagement.

An alternative means of ensuring the first body portion remains attached to the second body portion may be provided by a circumferential neck having a radial flange being disposed at the open end of the first body portion, and the second body portion may include a circumferential recess for receiving the flange with a snap-fit.

Alternatively, a circumferential neck with a screw thread may be disposed at the open end of the first body portion, and the second body portion may include a corresponding internal screw thread for engaging the threaded circumferential neck with a screw-fit.

Of the above three methods of ensuring the second body portion remains attached the first body portion, the bayonet engagement is the preferred method because a user can feel the deformable supporting means deforming around and engaging a chisel as the second body portion is moved towards the first body portion. Also, the bayonet engagement limits the rotational movement required to attach the second body which prevents unnecessary abrasion of the deformable supporting means.

The first body portion may also include an indicia display region disposed on the outer surface of the elongate box section, allowing identification of the chisel width able to be received by the case.

The deformable blade supporting means may include a V-shaped groove for receiving a tip of the chisel blade which helps to guide the tip into a centrally disposed position within the first body portion. The effect of both deformable supporting means may also ensure a chisel contained within the case maintains a substantially spaced relationship with the inside of the case, which minimises wear of the chisel.

BRIEF DESCRIPTION OF THE DRAWINGS

For a better understanding of the present invention, and to show more clearly how it may be carried into effect, reference will now be made, by way of example, to the accompanying drawings, in which.

DESCRIPTION OF PREFERRED EMBODIMENTS

Figure 1:
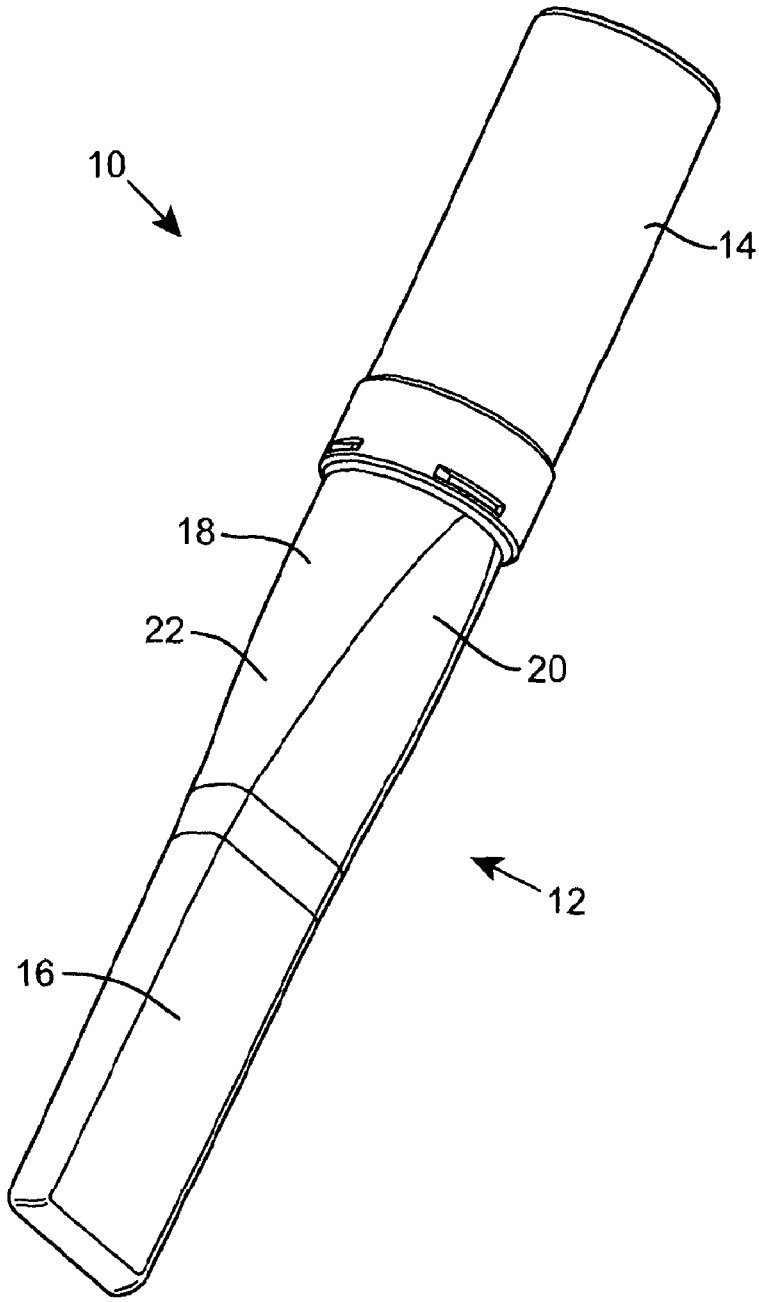
FIG. 1 shows a schematic perspective view of a chisel case in a first embodiment of the invention, with a first body portion attached to a second body portion.

Referring firstly to FIG. 1, a chisel case is indicated generally at 10. The chisel case 10 includes a first body portion 12 and a second body portion 14 attached to the first body portion 12. The first and second body portions 12, 14, are both hollow and may be manufactured from plastics, for example recycled plastics, which provide a rigid and robust chisel case 10. The first body portion 12 has a substantially elongate box section 16 for receiving a blade of a chisel in use. Adjoining the box section 16 is a tapered transitional portion 18, which tapers outwardly in a direction away from the box section 16. The transitional portion 18 has a rectangular lateral cross-section at the end adjoining the box section 16 and a circular cross-section at the opposite end. The transitional portion 18 has a pair of opposing planar surfaces 20 adjoining a pair of opposing curved surfaces 22. The planar surfaces 20 of the transitional portion 18 also smoothly adjoin the planar surfaces of the box section 16. The circular end 24 of the transitional portion is open-ended for receiving a chisel in use.

Figure 2:
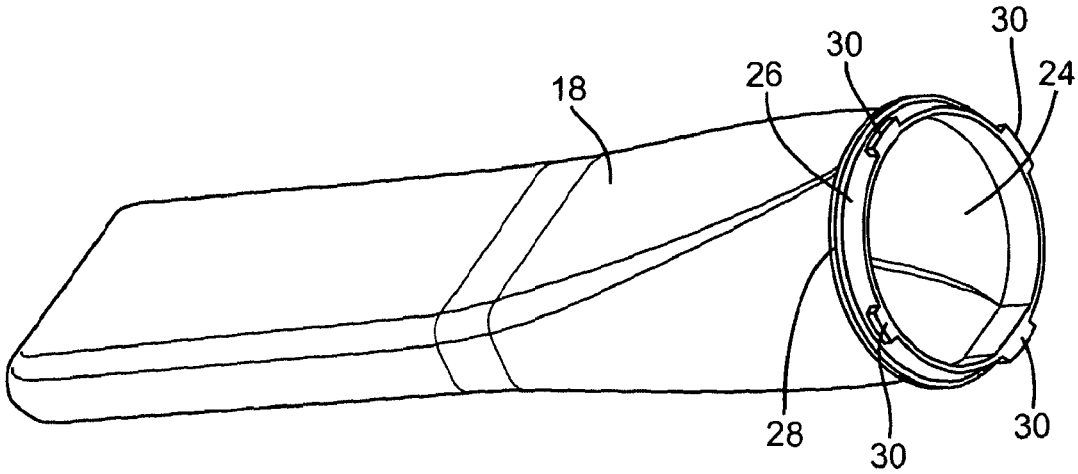
FIG. 2 shows a schematic perspective view of the first body portion of FIG. 1.

As best seen in FIG. 2, the circular end 24 is formed as a short cylindrical section or a ring 26, which adjoins the transitional portion in a circumferentially continuous outwardly extending flange 28 or shoulder extending therefrom. The flange 28 is spaced from the free edge of the ring 26 and is intermediate the ring 26 and the transitional portion 18. Four individual locking flanges 30 also extend outwardly from the ring 26 and are disposed intermediate the continuous flange 28 and the free edge of the ring 26. The flanges 30 may be at the free end of the ring 26. The individual flanges 30 are equi-angularly spaced about the ring 26 and are provided for engaging with corresponding spaces in the second body portion 14.

Figure 3:
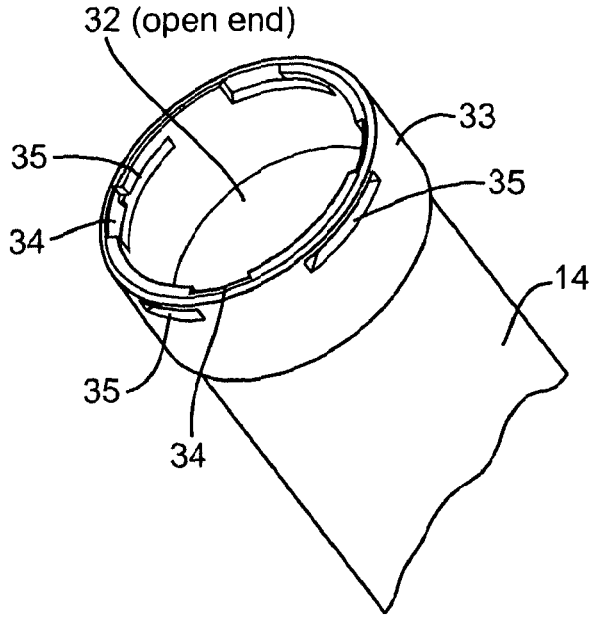
FIG. 3 shows a schematic perspective view of the second body portion of FIG. 1.

Turning now to FIG. 3, the second body portion 14 has a substantially cylindrical section for receiving a handle of a chisel. It has an open end 32 and an integrally formed closed end. A circumferential neck portion 33 is disposed at the open end 32. Four spaced recesses 34 are provided around the inside wall of the neck portion 33 and extend to its outer end. The recesses 34 extend into slots 35 extending through the thickness of the neck portion 33, spaced from the end of the neck portion 33 for engaging with the flanges 30 of the first body portion 12 in the manner of a bayonet fitting.

In use, as best seen in FIG. 1, the first and second body portions 12, 14 engage and lock together when the locking flanges 30 of the first body portion 12 enter the recesses 34 of the second body portion 14 and the first and second body portions 12, 14 are rotated relative to one another. The locking flanges 30 then engage in the slots 35.

Figure 4:
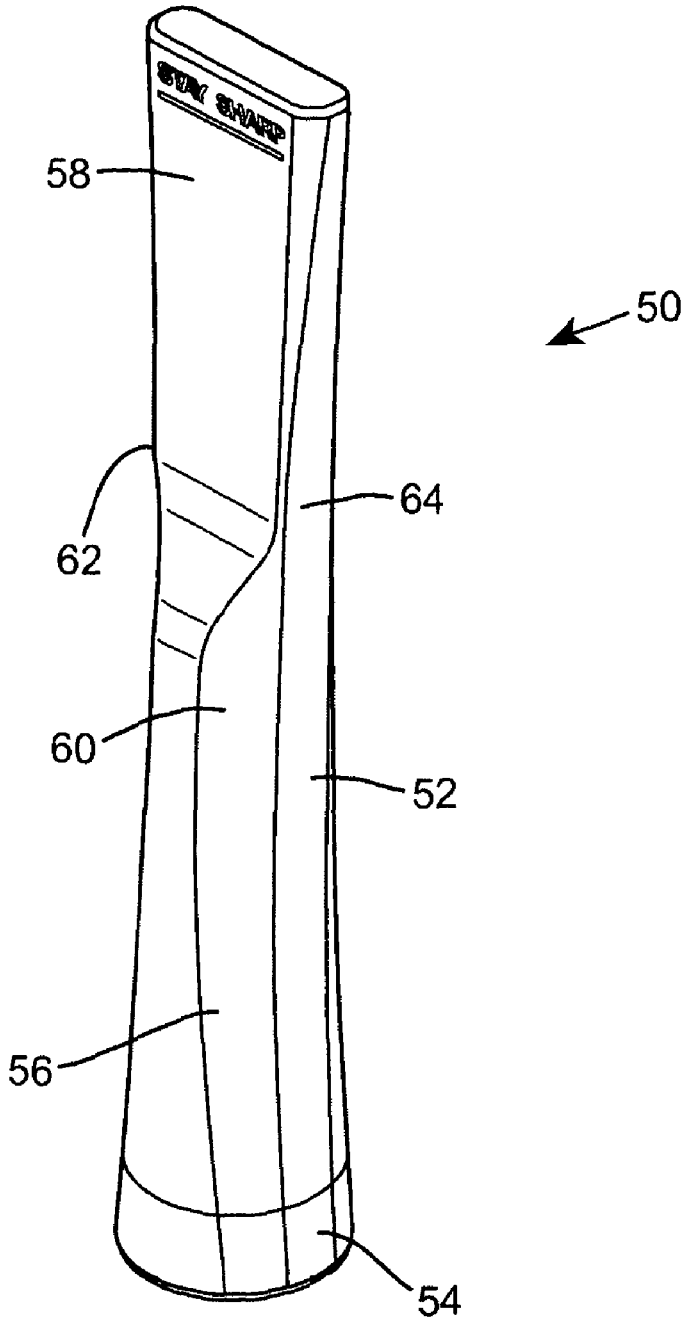
FIG. 4 shows a schematic perspective view of a chisel case in a second embodiment of the invention, with a cap portion attached to a body portion.

Referring now to FIG. 4, in a second embodiment of the invention, the chisel case 50 includes a first body portion 52 shown attached to a removable second body or cap portion, 54. The first body portion 52 has a substantially cylindrical section 56 for receiving the handle of a chisel. A substantially elongate box section 58 adjoins and is integrally formed with the first body portion 52 and in use receives a blade of the chisel. In a transition region 60 of the case 50, where the cylindrical section 56 meets the box section 58, the cross section of the case 50 becomes substantially octagonal. Two of the octagonal faces 62, 64 continue to form sides of the box section 58, but the other six faces, i.e. three faces on either side of the case, are necked into two single opposing faces of the box section 58.

Figure 5:
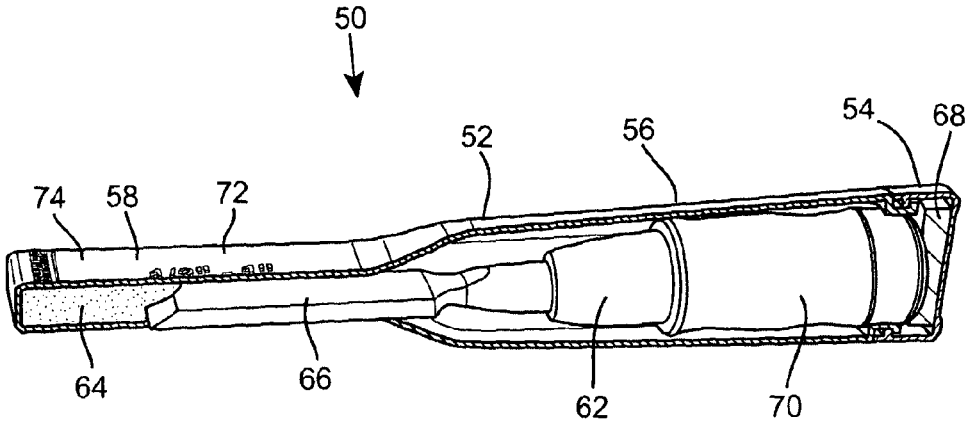
FIG. 5 shows a schematic cross-sectional view of the chisel case of FIG. 4 showing the position of a chisel contained within the case.

Referring also to FIG. 5, a chisel 62 is shown contained within the chisel case 50. A deformable blade supporting means 64 is disposed at the end of the elongate box section 58, for receiving and holding a tip of the chisel blade 66. A deformable handle supporting means 68 is disposed within the cap portion 54, providing cushioning and support for the chisel handle 70. An indicia display region 72 is disposed on a flat outer surface 74 of the elongate box section 58 to allow identification of the chisel width able to be received by the case 50. The deformable supporting means 64, 68 may be manufactured from foam or any other suitable material.

Figure 6:
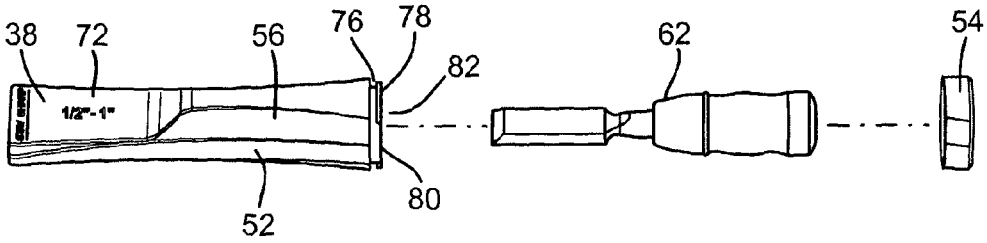
FIG. 6 shows a schematic exploded view of the chisel case body portion of FIG. 4, the chisel case cap portion and a chisel aligned for insertion into the body portion.

Referring also to FIG. 6, a circumferential neck 76 including a radial flange 78 is shown disposed at an open end of the first body portion 52. A pair of opposed spaces 80, 82 interrupt the radial flange 78, which align with a pair of inwardly directed radial flange portions (not shown) disposed within the cap portion 54 to provide a bayonet engagement. A bayonet connection is the preferred means of securing the cap portion 54 to the first body portion 52, but the cap could also be a screw cap or a snap-fit cap.

When a chisel 62 is inserted blade-end first into the first body portion 52 the blade comes to rest in a supporting region of the deformable supporting means 64. This may be shaped with a V-slot to assist engagement. Then, when the cap portion 54 is moved towards and attached to the first body portion 52, the user can feel the engagement of the deformable supporting means 64 and can confirm that the chisel 62 is well supported before the cap is secured. This effect is cause by the resilience in the deformable supporting means.

The chisel case is highly advantageous in storing and in particular transporting chisels. Its unitary body portions are made from durable plastics which protect a chisel blade from possible damaging contact with other tools, ensuring that a chisel contained within the case remains sharp. The deformable supporting means allow a chisel to be fully supported in a fixed position relative to the inside of the case. The chisel is maintained in a spaced relationship with the case and the deformable supporting means provides the user with confidence that the chisel is securely and safely contained within the first body portion as the second body portion is attached.

It is understood that variations may be made in the foregoing without departing from the scope of the invention. For example, the elements and teachings of the various illustrative embodiments may be combined in whole or in part in some or all of the illustrative embodiments within the scope of the claims.

The invention claimed is:

1. A chisel case for housing a single chisel comprising first and second unitary hollow body portions, co-operating engagement means provided on each body portion for locking the body portions together, a deformable blade supporting member disposed within the first body portion, the deformable blade supporting member having a V-shaped groove therein for receiving a tip of the chisel blade, and a deformable handle supporting member disposed within the second body portion, the first body portion being formed at one end as a substantially elongate rectangular box section for receiving a blade portion of the chisel.

2. A chisel case as claimed in claim 1, in which the first body portion has a substantially circular end and at least one tapered transitional portion, which extends between and adjoins the elongate rectangular box section with the substantially circular end.

3. A chisel case as claimed in claim 2, in which the at least one tapered transitional portion includes two substantially planar opposing surfaces, the width of said planar surfaces increasing as the taper decreases.

4. A chisel case as claimed in claim 2, in which the first body portion is open-ended at the circular end for receiving the chisel.

5. A chisel case as claimed in claim 1, in which the second body portion is formed as a tube having a substantially circular lateral cross-section.

6. A chisel case as claimed in claim 1, in which the second body portion is open-ended at one end for receiving a handle of the chisel.

7. A chisel case as claimed in claim 4, in which a continuous outwardly directed flange extends around the circular end of the first body portion, the flange being inset from the open end.

8. A chisel case as claimed in claim 7, in which the co-operating engagement means includes a circumferential neck disposed at the open end of the second body portion, said neck having a plurality of spaces provided therethrough, and a plurality of outwardly directed flange portions extending from the periphery of the open end of the first body portion for engaging the spaces of the circumferential neck of the second body portion in a bayonet engagement.

9. A chisel case as claimed in claim 4, in which the co-operating engagement means includes a circumferential neck having a radial flange disposed at the open end of the first body portion, and a circumferential recess provided on the second body portion for receiving the flange with a snap-fit.

10. A chisel case as claimed in claim 4, in which the co-operating engagement means includes a circumferential neck with a screw thread disposed at the open end of the first body portion, and a corresponding internal screw thread on the second body portion for engaging the threaded circumferential neck with a screw-fit.

11. A chisel case as claimed in claim 1, in which an indicia display region is disposed on the outer surface of the substantially elongate rectangular box section.

12. A chisel case as claimed in claim 1, in which the deformable supporting means are adapted to support a chisel in a substantially spaced relationship with the inside of the case.

* * * * *